United States Patent [19]

Stroszynski

[11] 4,085,522

[45] Apr. 25, 1978

[54] METHOD AND APPARATUS FOR FREELY SUSPENDING MOVING WEBS OF MATERIAL

[75] Inventor: Joachim Stroszynski, Naurod, Germany

[73] Assignee: Hoechst Aktiengesellschaft, Germany

[21] Appl. No.: 410,340

[22] Filed: Oct. 29, 1973

[30] Foreign Application Priority Data

Oct. 30, 1972 Germany ..... 2253170

[51] Int. Cl.[2] ..... B65H 17/32; F26B 17/10

[52] U.S. Cl. ..... 34/156; 34/155; 226/7; 226/97

[58] Field of Search ..... 34/16, 23, 155, 156, 34/160; 226/7, 97

[56] References Cited

U.S. PATENT DOCUMENTS

| | | | |
|---|---|---|---|
| 3,060,594 | 10/1962 | Meier-Windhorst | 34/156 |
| 3,384,282 | 5/1968 | Vits | 34/156 |
| 3,549,070 | 12/1970 | Frost | 34/156 |
| 3,680,223 | 8/1972 | Vits | 34/156 |
| 3,807,056 | 4/1974 | Norfolk | 34/156 |
| 3,823,488 | 7/1974 | Houben et al. | 34/156 |
| 3,982,328 | 9/1976 | Gustafsson et al. | 226/97 |

FOREIGN PATENT DOCUMENTS

| | | | |
|---|---|---|---|
| 768,851 | 10/1967 | Canada | 34/156 |
| 1,148,944 | 5/1963 | Germany | 34/155 |
| 894,237 | 4/1962 | United Kingdom | 34/155 |

*Primary Examiner*—Charles J. Myhre
*Assistant Examiner*—Parshotom S. Lall
*Attorney, Agent, or Firm*—James E. Bryan

[57] ABSTRACT

This invention relates to a method for freely suspending a moving web of material in a gaseous medium, which comprises impinging a stream of the gaseous medium over the entire width of one surface of the web in order to produce a first stationary stable pressure zone, forming at least one stationary stable suction zone adjacent said first stationary stable pressure zone, deflecting the gaseous medium passing beyond the edges of the web in order to produce a second stationary stable pressure zone on the opposite side of the web, and regulating said pressure and suction zones in order to maintain the web in a freely suspended state. The invention also includes an apparatus for performing the method.

29 Claims, 24 Drawing Figures

METHOD AND APPARATUS FOR FREELY SUSPENDING MOVING WEBS OF MATERIAL

This invention relates to a method and apparatus for freely suspending webs of material by purely aerodynamic methods, especially webs of paper, plastic materials, metals or laminates of these materials, and especially for drying such webs after coating processes.

The present invention will now be described in greater detail by way of example only with reference to the accompanying drawings. In the following description, for the purpose of simplicity only the impingement system is referred to as the G-system and the receiving system as the E-system.

Figure 1:
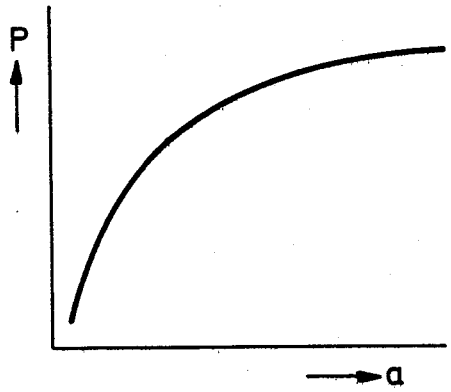
FIG. 1 is a graph in which repelling force P is plotted against the distance *a* between the jet orifice and the material web.

Conventional air jets, as are used for example in standard driers, are not suitable for achieving a suspension effect because the repelling force P becomes progressively smaller and finally zero as the distance *a* between the jet orifice and the material web decreases (see FIG. 1 of the accompanying drawings). Therefore contact-free and smooth transport of the material web by means of aerodynamic forces is not possible. In this case damage is caused to the web by the latter striking against the jet, rendering the product unsalable.

French Pat. No. 1,421,631, for example, discloses a process and apparatus in which the material web is treated and conveyed in the suspended state by a two-sided attach with gaseous and vaporous processing media from appropriate jets.

For the pure aerodynamic transport of webs, jets with a so-called stable characteristic curve are necessary, i.e. in such jets the repelling and supporting force between the material web and the jet orifice becomes greater when the material web approaches the jet orifice.

Figure 2:
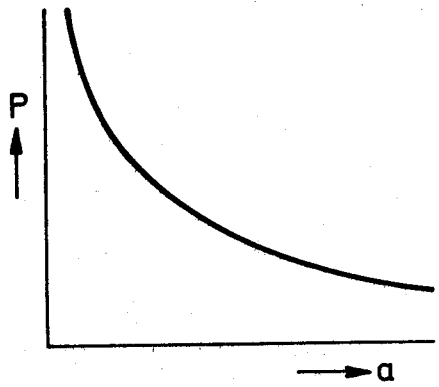
FIG. 2 illustrates the supporting characteristic curve of a known supporting jet with two converging slot-like streams emerging transversely to the direction in which the material is running.

In FIG. 2, for example, there is illustrated the supporting characteristic curve of a known supporting jet with two converging slotlike streams emerging transversely to the direction in which the material is running, the escape of gas from between the streams being prevented by the setting-up of stable pressure zones, and the streams of gas pushing the material web away from the jet orifices. The supporting force curve per unit length of the jet falls when the jet pressure is constant, first of all strongly, substantially hyperbolically, with increasing distance *a* between the jet orifice and the material web, and then increasingly flatter. The characteristic curve of such a jet is naturally dependent on both geometry and the jet pressure. If the dimensions of such a jet are correct, systems of curves with the above-described tendency are obtained with different jet pressures, which tendency is basically applicable for stable jets.

Figure 3:
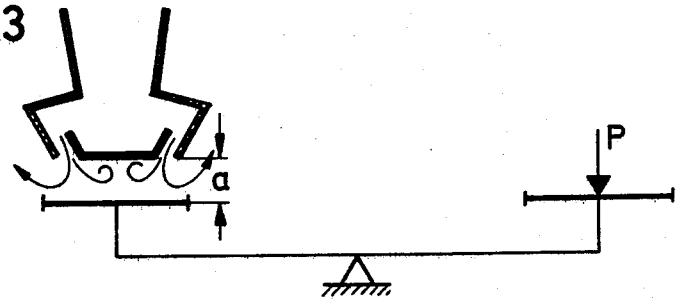
FIG. 3 illustrates a device for determining the characteristic curve of a jet.

In FIG. 3 there is shown a device for determining the characteristic curve of a jet. If the pressure of the gaseous medium is kept constant while the weight or the force P is altered on the right hand side of the balance so that equilibrium prevails, then the supporting force of the jet for the respective distance *a* is obtained. In a device with a jet formation, the streams emerging from the jets and the pressure zones produced between the streams push the material web away from the jet orifices. If the same measurements are effected on the other side of the material web then in accordance with FIG. 4 the repelling effect of the jets found there is also obtained. If the repelling forces acting on both sides of the material web are balanced and if their resulting absolute forces are sufficiently great in comparison with the weight of the material web, then the material web is reliably held in the suspended state by these resulting aerodynamic forces. Depending on the slope of the jet characteristic curves, which do not have to be precisely the same, the position of the material web appears between the supporting forces applied to both sides of the material web. It must be understood that the magnitudes of the supporting forces transverse to the web should vary as little as possible.

Figure 4:
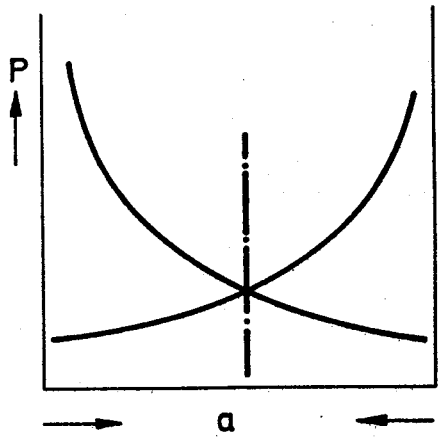
FIG. 4 illustrates the case in which positive forces proceed from both sides of the web and an equilibrium of forces is achieved.

The known processing method using suspended action, and the known apparatus for achieving a suspended effect are based on the fact that by means of the corresponding jets and special arrangements, positive forces must proceed from both sides of the web, i.e. forces must proceed from the jets on both sides of the web, in order to be able to achieve an equilibrium of forces as represented in FIG. 4. This therefore requires jet systems, with the same technical expenditure, on both sides of the material web. Here, the advantage in this method for conveying material in the suspended state is achieved with higher expenditure and greater costs in comparison with conventional roller transport. In the case of repeated successive processing of the material web, e.g. coating followed by drying or the like, apparatus for suspended transport will be relatively long, i.e. it will consist of several stages. The pure suspension drier in comparison with conventional driers with roller transport is therefore considered only if there are requirements for freedom from scratches and/or simultaneous processing of both sides of the material web.

The present invention provides a method which is more simplified and thus more reliable in operation, than the former processes, in which the processing medium strikes both sides of the material with comparable processing efficiency.

The present invention provides a method for freely suspending a moving web of material in a gaseous medium which comprises causing one surface of the web to be impinged upon, preferably over its entire width, by a stream of the gaseous medium, so as to produce stationary stable pressure zone, creating adjacent to the stationary stable pressure zone one or more stationary stable suction zones, and so regulating the pressure and suction zones as to maintain the web in a freely suspended state.

The pressure invention also provides a method for freely suspending a moving web of material in a gaseous medium, which comprises causing substantially the whole of one surface of the web to be impinged upon over its entire width by a stream of the gaseous medium so as to produce a first stationary stable pressure zone, and causing the gaseous medium passing beyond the edges of the web to be deflected to produce a second stationary stable pressure zone on the opposite side of the web so as to maintain the web in the freely suspended state.

In a preferred method of the invention, the two methods described above are combined, the suspended state of the material web being stabilized even further.

By material webs there are to be understood, for example, textile webs, plastic foils and metal strips. The term "processing" is intended to mean, inter alia, the drying of coatings, the second and third processes described above being suitable for simultaneous two-sided processing.

The gaseous processing medium which passes beyond the edges of the material web and which is deflected onto the opposite side of the web is hereinafter referred to as the dynamic excess of the gaseous processing medium.

Preferably the methods of the present invention are carried out in such a manner that the stable pressure zones are produced by slot-like streams, i.e. the jets are slot-shaped. In a preferred arrangement, streams are used with stable characteristic curves which converge in pairs, between which streams the stable pressure zones are formed, the down-flow of the gaseous medium between the converging streams being prevented. To make optimum use of the processing effect in question, the processing medium used is preferably a heated gaseous or vaporous medium, wherein the drying effects are utilized differently in accordance with the process used. Depending on the intensity of impingement on the pressure or counter-pressure side of the web different results are obtained in the processing, in particular the drying processes. For example, the diffusion processes in a paper web are differently influenced depending on the intensity of impingement on the counter-pressure zone side as compared with the pressure zone side, or for example, by decreasing the intensity of processing on the pressure zone side and increasing it on the counter-pressure zone side, uniform drying of a layer applied beforehand to the pressure zone side may be achieved without the layer becoming faint or dull as a result of undercooling and deposition of moisture. The heating of the processing medium, for example air, may be effected by known means, primarily by steam heating over a heat exchanger.

The two processes which are operated with a dynamic excess of the processing medium, that is in which part of the processing medium is deflected onto the side of the web remote from the delivery side of the processing medium, may be carried out in such a manner that the deflection produces a static or dynamic counter-pressure zone. It is however, also possible to create a combination of static and dynamic counter-pressure zones which depends respectively on the choice in the arrangement of deflection mechanism as described below.

When carrying out the process of the invention, it has proved advantageous if the dynamic excess is collected and reversed in as broad as possible a receiving system. In practice, it has proved particularly advantageous if a uniform flow is produced by a flow distributor in the suction zones which lie between or adjacent to the pressure zones. It is of particular advantage here if the suction of the processing medium is effected substantially perpendicular to, transverse to, and above the material web. In particular, a completely uniform distribution of the discharge velocity of the processing medium is provided in the direction transverse to the direction of travel of the material web. As a result of this feature, a further uniformity of the suspended state of the material web is obtained, and thus waving of the web is substantially completely prevented.

In order to achieve a strong processing effect on both sides of the material web, the processes operated with a dynamic excess are carried out in such a manner that the discharge velocity and the throughput of the processing medium is higher in that part projecting beyond the edges of the material web than in the impingement area of the material web. This may be effected, for example, by corresponding formation of the impingement jets or by subdivision of the jets and corresponding coating with the processing medium. Even if there are no absolute limits in the discharge velocity, it has been shown in practice that for the usual drying and treatment processes a velocity between next to zero and 60 m/sec for the processing region is completely adequate.

A further modification is that the discharge velocity of the processing medium can be regulated to a sustantially higher level than the return speed from the receiving system.

Even though the material web can be conveyed at any distance between the emitting and the receiving system, it has proved especially advantageous in practice, because of the uniformity of processing and the absolutely reliable transport, if the pressing power of the delivery system i.e. emitting side, and the counter-pressing power of the receiving system or the pressing and suction power of the emitting side and the counter-pressing power of the receiving system are regulated in such a manner that the material web is conveyed in the suspended state at the same distance between the emitting and receiving systems.

Since the receiving system in a normal drying unit consists of several individual systems, it is advantageous if an equilization of pressure is produced between the individual receiver jets which is accomplished by appropriate installations.

There is no principle limitation in constructing the stable pressure zones but, above all, satisfactory results have been achieved by systems in which the pressure zones are arranged in parallel, at right angles, balanced, closed and transverse to the direction of movement of the web. The dynamic excess of the processing medium is preferably reversed in the receiving system in such a manner that the counter-pressure forces have a stable characteristic curve in any supporting region concerned, as stated above. It is also of special advantage if the resulting forces of the pressure and suction zone or the pressure and suction zones of the emitting system and the counter-pressure zones of the receiving system are regulated in such a manner that they have a stable point of intersection within the distance between processing (emitting) system and receiving system.

According to a further feature of the invention, it is also possible to effect the supply of the receiving system with the processing medium in such a manner that the material web is not substantially impinged on the emitting side by the processing medium. For this purpose use is made of appropriately formed jets and corresponding covers, in particular jet covers. In the borderline case, the material web is conveyed in the suspended state and processed by the action of the pressure zones and the impingement from the receiving jets and/or by the action of the suction zones against the weight of the material web.

Here the suction zones on the emitting side and the pressure zones on the receiving side, which are set up by the dynamic excess, must be correspondingly balanced. This process is of special advantage for uniformly drying sensitive layers, for example, light-sensitive layers, which are facing the emitting jets. On the other hand, the process can be used to dry layers on the receiving jet side, for example, which occasionally may result in particularly favorable machine designs for a certain product, if, for example both sides must be coated in succession.

In accordance with the invention, the material web is conveyed and processed in the freely suspended state, streams of a gaseous or vaporous medium, preferably of a certain temperature, being emitted from at least one so-called emitting jet of prepondantly stable character, especially from a jet known in itself with two converging slot-like streams emerging transverse to the direction of movement of the material web, the downflow of which to the inside of the streams is prevented by the formation of stable pressure zones, impinging on the material surface to be treated, and pushing the material web away from the emitting jet orifices. The dynamic excess on the projecting emitting jet sides is freely received laterally by the material web, and pressure zones are produced transverse to the material web over at least one so-called receiving jet arranged below the material web, achieving a secondary processing effect, which pressure zones are equal to the repelling forces of the associated emitting jet in one point and/or suction zones, formed transverse to the material web on the longitudinal sides of at least one emitting jet, drawing the material web against the repelling forces of the emitting jet streams and pressure zones to the equilibrium distance, thus holding the material web in suspension.

Figure 5:
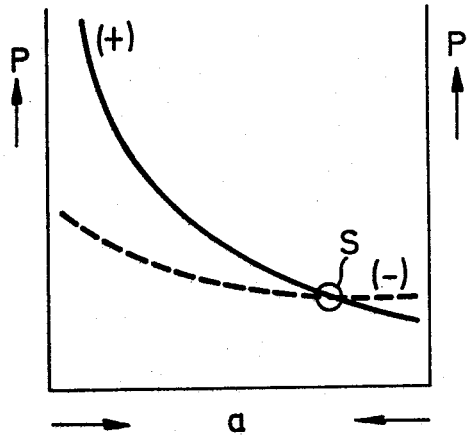
FIG. 5 illustrates the case where air streams from jets act unilaterally on one side of the material web and repel the material web from the jet orifices. The suction force produced lifts the web in the direction of the jet orifices until an equilibrium prevails between the repelling and suction forces.

In accordance with the invention, the material web is held in the suspended state if, for example, air streams from jets of stable characteristic curve act unilaterally on one side of the material web to be treated, and repel the material web from the jet orifices, while between the same jets the downflowing gaseous processing medium is drawn off contrary to the resulting discharge direction from the jets. The suction force produced here lifts the web in the direction of the jet orifice until an equilibrium prevails between repelling and suction forces; for example as shown in FIG. 5. The plus sign (+) in FIG. 5 indicates the repelling force of the jet streams or pressure zones, while the minus sign (−) indicates the suction forces between these jets. Above all, the point is that the negative characteristic curve does not come to rest over or under the positive characteristic curve. Moreover, it is advantageous for reasons of stability that when the distance to the jets is decreased, the resulting suction force increases substantially less than the repelling force of the jet pressure zone. The positive and negative characteristic curves consequently must be so adjusted by suitable measures both in their gradients and their tendency that a so-called positive point of intersection S of the characteristic curves is obtained, i.e. as already mentioned, that in the vicinity of the jets the repelling force is greater than the suction force, and that necessarily at a larger distance from the jet the suction force is outweighed and the material web is drawn in the direction of the jet orifice.

The preferred feature of the invention for the increased realizatiion of the supporting and processing effect is achieved by the use of the so-called dynamic excess in the processing medium which emerges on the left and right from the blast jets arranged in particular transverse to the direction of the material web, without directly impinging the material web to be treated which is as a rule narrower than the blast jets. The dynamic excess is collected in the space facing the rear side of the material web and deflected to produce a counter force in the direction of the blast (emitting) jet. Here, in accordance with the invention, compensating forces with a positive point of intersection are formed which themselves may be sufficient to achieve a suspension effect of the material web. The supporting effect produced in addition to the negative characteristic curve on the receiving jet side of the material web furthermore stabilizes the position of the material web in the suspended state, on the one hand, and on the other hand increases the processing effect, or the drying by secondary or rear side impingement of the material web. The supporting systems necessary for the conversion of the dynamic excess into carrying and processing action may, in accordance with the invention, depend on the demand of varying construction. Generally it is, however, either a symmetrical system, i.e. a receiving jet construction standing directly opposite the emitting jets, or an asymmetrical construction i.e. a receiving jet construction displaced with respect to the emitting jets.

In addition, the receiving jets themsleves can again, as also applies to the emitting jets, be statically and/or dynamically active. In a statically acting jet, dynamic forces are converted into static forces by means of a diffuser effect, for example, and in a dynamically acting support jet the pulse delivered by the gas streams onto the web is used for the crrying effect. As has already been described, statically and dynamically operating receiving-support-jets may cooperate.

The term "emitting jet" is used to mean the primary jet, i.e. the jet having the relatively higher jet pressure and the greater processing capacity and being supplied directly with the processing medium, while the receiving jet or secondary jet is supplied with processing medium from the emitting jet and has the smaller jet pressure and accordingly generally has the smaller jet capacity. This may be necessary in blast sensitive layers which do not endure impingement of the material web from the layer side.

By means of the superposition of the aerodynamic forces from the emitting jets and the receiving jets acting in such a manner on the material web, a trouble-free suspended state of the material web at different processing capacities is achieved without the above-described disadvantages of the conventional suspension drier.

In the case where the length of the emitting jets does not exceed the width of the material web, the suction zones come into action. The material web is likewise processed here in a trouble-free suspended state. The distance of the web from the emitting jet becomes slightly larger than without the secondary jet action.

The present invention also concerns suitable devices for carrying out the process.

In one device, on one side of a material web 1 to be processed and/or conveyed in the suspended state, there is arranged, working transverse to the direction of movement of the web, at least one jet 4 of stable characteristic curve, having a length which is smaller or equal to the width of the material web and into which is fed the processing medium by known measures, as well as suction mechanisms arranged between or adjacent to the jet by means of which the processing medium flowing out of the processing chamber is drawn off.

In a further device for an alternative method for carrying out the process, on one side of a material web 1 to be processed and/or conveyed in the suspended state, there is arranged, working transverse to the direction of movement of the web, at leat one jet 4 of stable characteristic curve having a greater length than the width of the material web and into which is fed the processing medium by known measures, as well as a stable receiving system arranged on the rear side of the material web in which the dynamic excess of the processing medium flowing away over the edges of the material web is collected and turned around.

Further variations of the device are operating the above described devices in combination or only with emitting jets which are longer than the material web width, i.e. which produce a dynamic excess of the processing medium, and in combining this emitting system with the suction devices lying between the jets.

In a preferred embodiment of the devices operating with dynamic excess flow, distributors are built into the suction zones (minus zones) thus producing a uniform flow field. In particular, the flow distributors are in the upper part of the suction zone and are similar in profile to the inside body of the preferably converging jet and that of the receivig system.

Figure 6:
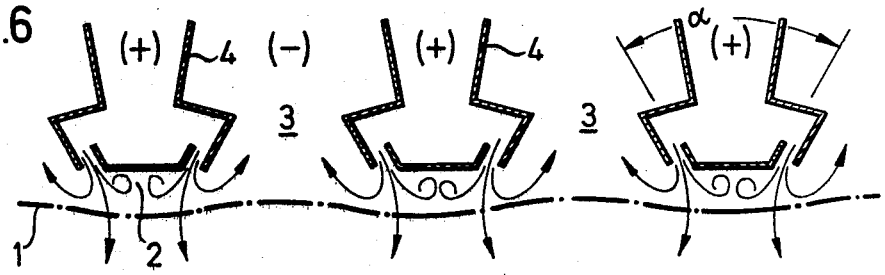
FIG. 6 is a schematic representation of the system of forces in the formation of support jets with converging jet streams.

FIG. 6 is a schematic representation of the structure of forces in the formation of support jets with converging jet streams. The positive forces (+) from the stable pressure zones 2 repel the material web 1, while the negative forces (−) in the stable suction zones 3 between the jets 4 attract the matrial web. In order to reach a positive point of intersection S as illustrated in FIG. 5, the positive and negative characteristic curves obviously must be brought into line with each other. On the support jet side, for example, a relatively steeply falling curve at constant jet pressure can be achieved if the converging angle $\alpha$ of the double stream jet is enlarged. On the negative side, a relatively high suction force is obtained by altering the suction capacity in relation to the pressing capacity in favor of the suction capacity, e.g. by removing the processing medium on the pressure and/or suction side. As a result, the necessary ventilation, e.g. in a drier, is advantageously effected. On the other hand, on the negative side a relative increase in the suction force is achieved by small distances of the material web with respect to the jet and by counterbalanced flow cross-sections on the discharge side. The suction performance graph of a ventilator, for example, therefore must be adjusted to the flow resistances and the reversed heat-pressure of the entire system as well as to the total quantities of the processing medium, preferably air, in order to obtain a positive point of intersection between the positive and negative curves.

Figure 7:
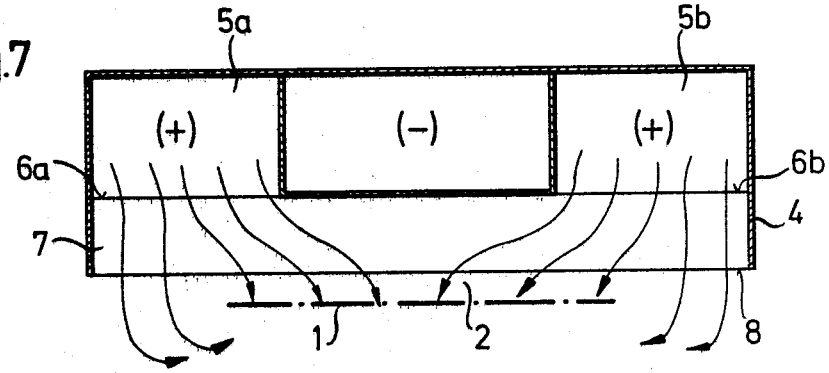
FIG. 7 illustrates the structure of the positive force field transverse to the direction of movement of the material web.
Figure 8:
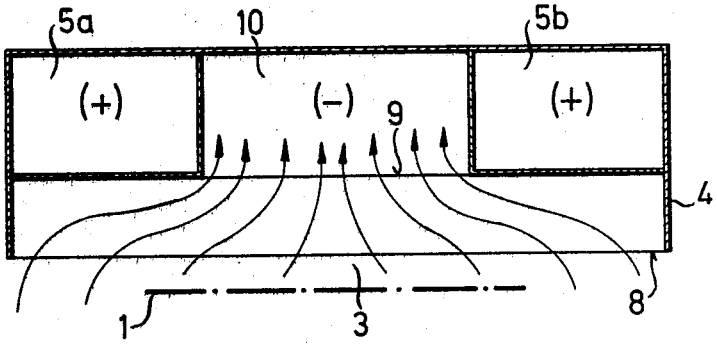
FIG. 8 illustrates the structure of the negative force field transverse to the direction of movement of the material web.

FIGS. 7 and 8 show how a positive-negative flow field with corresponding force distribution is undertaken in accordance with the invention in an initially open housing of a procesing device transverse to the material web.

According to FIG. 7, the air from the two positive chambers 5*a* and 5*b*, which are arranged on the outside in the direction of movement of the material, is forced into the jet 4 through the jet inlets 6*a* and 6*b*. A uniform distribution of pressure and velocity is achieved in the cavity 7 of the jet 4 by suitable measures e.g. by corresponding dimensions in the hollow body of the jet and in the inlet cross-sections which are approximately half as large as the total width of the jet. The air thus flows in uniform distribution out of the jet orifices 8 - corresponding to the slot-shaped jet discharge cross-sections, here ray-shaped - and strikes the material web forming stable pressure zones 2. The pressure force field distributed transversely over the material web between the material web 1 and the jet orifices 8 repels the material web from the jet orifices.

FIG. 8 schematically illustrates the structure of the negative force field transverse to the material web. The air, which is drawn in between the jets 4 flows, after brief deflection around the jet orifices 8 and outer edges, after the impact of the material web, uniformly distributed by the draw-in cross-section 9, into the negative chamber 10. The inlet length in the negative chamber, which is arranged between the positive chambers 5*a* and 5*b*, is here approximately half as large as the working length of the jets. As a result of the special shape of the support jet body, uniform discharge of the return air is achieved on the outside. The suction force fields 3 constructed in this manner between the jets 4, are transverse to the direction of movement of the material, and attract the material web in the direction of the jets in the jet formation on both sides against the repelling force of the pressure zones.

It can be seen from FIGS. 6, 7 and 8 that positive and negative force fields alternate longitudinally to the direction of movement of the material, and that the air from the support jets, after impingement on the material web, flows around the jets transversely and passes in the shortest path upwards into the negative chambers.

Similar to FIGS. 7 and 8, in another embodiment, not illustrated, the negative chambers can be placed on the outside and the positive chambers on the inside without in principle giving up the positive-negative structure represented in FIG. 6. In the case of very wide processing channels it even may be advantageous if the positive-negative structure is multiply subdivided.

For structural and practical reasons it is advantageous, however, to select the structure in accordance with FIGS. 7 and 8.

FIGS. 6, 7 and 8 serve primarily for the description of a method of effecting the method of the invention and one of the devices. It is obvious that the stable suction and pressure zones are formed by means of suitable conveying mechanisms and ventilators, and that each practical device for effecting the process advantageously maintains a secure seal under the material web.

Figure 9:
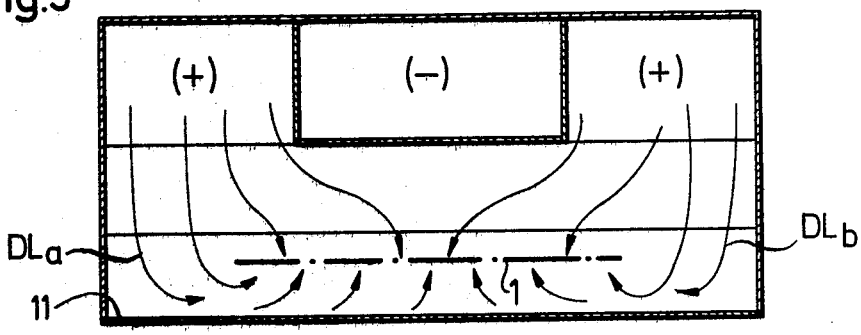
FIG. 9 illustrates the structure of a closed device.

FIG. 9 illustrates the structure of a closed device. In comparison with FIGS. 7 and 8 the chamber base 11 is disposed under the material web 1, which base stands at some distance from the material web and closes the processing device below the web.

Since, in a preferred arrangement, the width of the material web is for practical reasons generally smaller than the length of the jets, a portion of the processing medium flows past the material web on the outside of it. This excess, which contains a relatively high kinetic energy and is called herein a dynamic excess DL, is freely collected at the side of the material web and is used to achieve secondary processing effects on the rear side of the material web, and to form, or to increase, reaction forces which work in opposition to the repelling forces of the emitting jet. In accordance with the invention the dynamic excess is turned aside and/or collected in a receiving system, which will be described in more detail below, which system exerts considerable stabilization and counter-pressure effects on the material web. It is even possible in the case of material widths which are, for example, approximately 10% smaller than the primary jet lengths, to achieve a trouble-free suspended transport of the material web by means of the actions arising between the stable emitting jet system and the stable receiving jet system.

As already indicated, the receiving system which is likewise of stable nature, may have a symmetrical or asymmetrical structure. A combination of both systems is also possible.

As a result of the superposition according to the invention of the stable emitting-receiving jet system with the stable positive-negative system, an extremely efficient process for processing material webs in the suspended state is achieved, especially in the case of relatively large web widths as compared with the jet lengths.

FIGS. 10, 11, 12, 13, 14, 15, 16, 17 and 18 illustrate embodiments for the emitting-receiving systems with stable curves in accordance with the invention. For the sake of simplicity in the drawings, the emitting jets are not varied in construction since the only important point is that the emitting jets, as already described, have stable characteristic curves.

Figure 10:
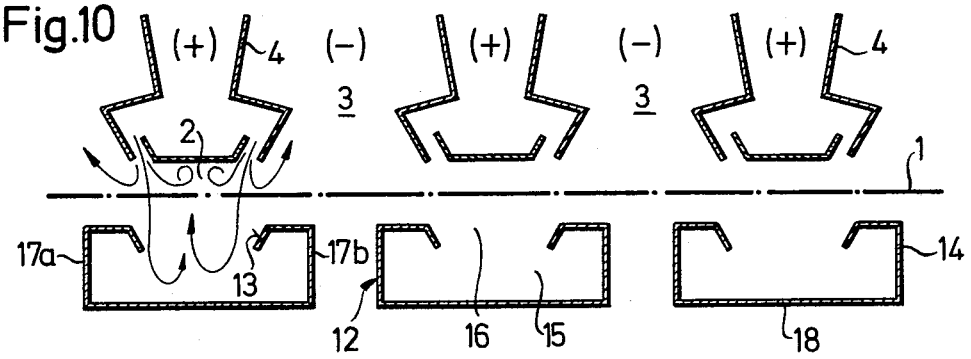
FIG. 10 illustrates the symmetrical structure of a stable G-E-system.

In FIG. 10 the primary or emitting jets 4 are arranged above the material web 1. The streams of the processing medium leaving the emitting jets 4 transverse to the material web 1 are conveyed after direct impingement into the suction zones (negative zones) 3. The dynamic excess is collected on the side of the material web opposite the emitting jets by funnel-shaped receiving jets 12. The receiving jets (E-jets), which are transversely arranged underneath the material web, are disposed under the emitting jets (G-jets). The E-jets in FIG. 10 are so formed that the inlet funnels 13 collect as much as possible of the dynamic excess flowing out of the converging single jets and distribute the collected portion of the dynamic excess as uniformly as possible over the E-jet inside the E-jet body 14 or E-jet cavity 15 to support the material web from there, against the repelling forces of the G-jet. As a result of the diffuser-like and relatively broad formation of the E-jet slot 16 the material web can, on the one hand, give away downwards in the direction of the E-jets to the repelling forces of the G-jets without touching the E-jets, and, on the other hand, the E-jets can oppose a relatively wide pressure zone with stable behavior towards the G-jet forces. In this way a relatively simple but stable G-E-system is obtained.

A good distribution of the dynamic excess DL*a*; DL*b*; in the E-jet body formed by the inlet funnel 13, the side walls 17*a;b* and the jet base 18 is obtained by a relatively large E-jet cavity 15 which may reach as far as the next E-jet body. The E-jet body encloses the E-jet cavity as far as the E-jet inlet funnel 13 or the E-jet orifice 13, in this case a slot-shaped diffuser jet. In FIG. 10 each G-jet forms in the E-jet associated with it, by means of the dynamic excess, a pressure zone which remains stable transverse to the material web and counteracts the G-jet pressure. The processing medium is supplied laterally to the E-jets and conveyed out again uniformly under the material web. In the equilibrium state of the aerodynamic G and E jet forces, the material web is held in suspension. This suspended state appears with relatively low velocities of the processing medium from the G-jets, and is also produced when the velocities are very high. Depending on the requirement, the discharge velocities from the G-jets preferably may lie between approximately zero and 60 m/sec. In special cases where it is only a question, for example of stabilizing a material web in its position, e.g. before coating, the discharge velocities may be substantially higher.

On attracting the co-called negative components into the suction zones, the material web is additionally raised between the emitting jets and thus drawn closer to the emitting jet orifices. An increase in the processing intensity is thereby achieved.

Figure 11:
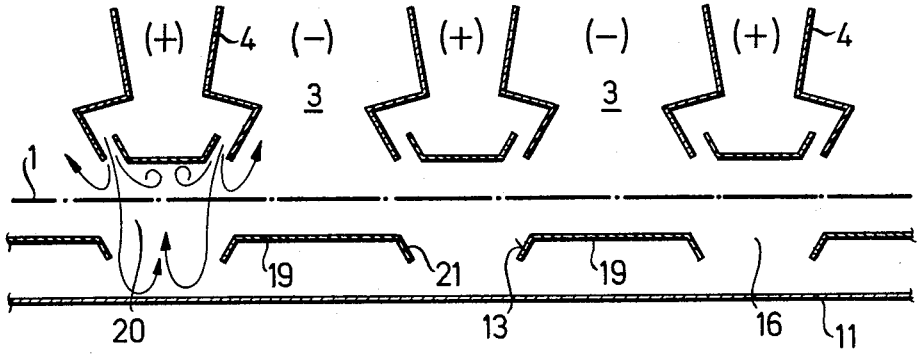
FIG. 11 illustrates the symmetrical structure of a stable G-E-system with equalization of pressure.

A simple stable G-E-system with pressure balance within the E-system is illustrated in FIG. 11. Here the E-jet slots are formed in each case by two identical profiles 19 which are arranged below and parallel to the G-jet. The profile 19 for the formation of the inlet funnel 13 and simultaneous jet slot 16 is so selected that a diffuser-like outlet 20 of the processing medium is achieved. The side arms 21 maintain to some extent the convergence angle of the G-jets if e.g. a buckled arrangement of the profile is selected. Identical supporting effects from the E-jet are also obtained with curved profiles. Here the E-jet profiles extend below and transverse to the G-jets, from G-jet to G-jet as far as the so-formed parallel E-jet slot which advantageously should be somewhat wider at the outlet than e.g. the width of the G-jet at its outlet, in order to achieve a good capture of the dynamic excess on the one hand, and on the other hand to obtain wide and relatively non-sensitive pressure zones. There are no cutoffs between the drier base 11 and the profiles 19 of FIG. 11. By means of this free space connection an equalization of pressure occurs between the individual E-jets which has a steadying effect on the behavior of the material web if as a result of inaccuracies in manufacture the required force structure differs to some extent from E-jet to E-jet. Advantages in functional efficiency are produced in particular by the structure of the E-systems according to FIG. 11.

Figure 12:
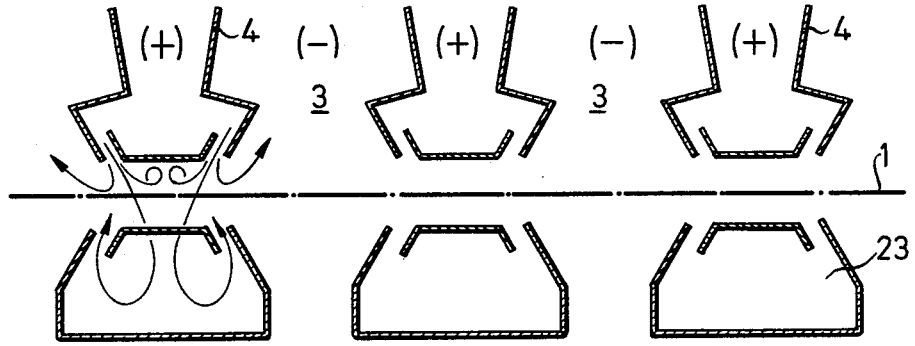
FIG. 12 illustrates the symmetrical structure of a stable G-E-system with dynamic supporting action.

A further type of embodiment of the receiving jet system is illustrated in FIG. 12. This is a symmetrical structure between the stable G and E jet system with dynamic supporting action on the E-jet side, i.e. the E-jets, similar to the illustrated G-jets, form impulse forces against the material web by means of converging air streams, which forces increase when the material web approaches the jet orifices. The injection orifices 23 on the E-jet margins are arranged outside the width of the material and are characterized by simple orifices so that the dynamic excess can flow into the E-jets with the smallest possible losses in pressure.

The dynamic excess is chiefly turned around only in the E-jets according to FIG. 12. A supporting effect similar in principle, which derives from the G-jets illustrated, is thus achieved by dynamic means, against a diffuser action as described in the examples of FIGS. 10 and 11, where, chiefly by the formation of higher static pressures than in the inlet jet of the dynamic excess, the supporting cushions of the diffuser jets are constructed.

Advantageously, the E-jet according to FIG. 12 is so formed that its characteristic curve is steeper than that of the G-jet. As a result, a relatively small dynamic excess is required to initiate a lifting of the material web in the direction of the G-jet.

Similarly to FIGS. 10 and 11, the jets of FIG. 12 may on the one hand be arranged individually under the material web opposite the G-jets, parallel and transverse to the direction of movement of the web, so that there is a separate processing system between each G-jet and the E-jet associated with it, and on the other hand the E-jets may be spatially freely connected one below the other so that here, too, an equalization of pressure from E-jet to E-jet is achieved.

Figure 13:
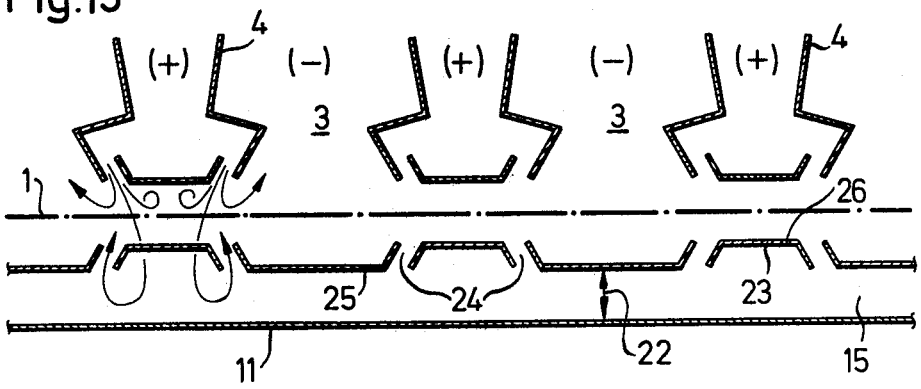
FIG. 13 illustrates an E-jet system with dynamic supporting jets and inner pressure balance (symmetrical arrangement)
Figure 14:
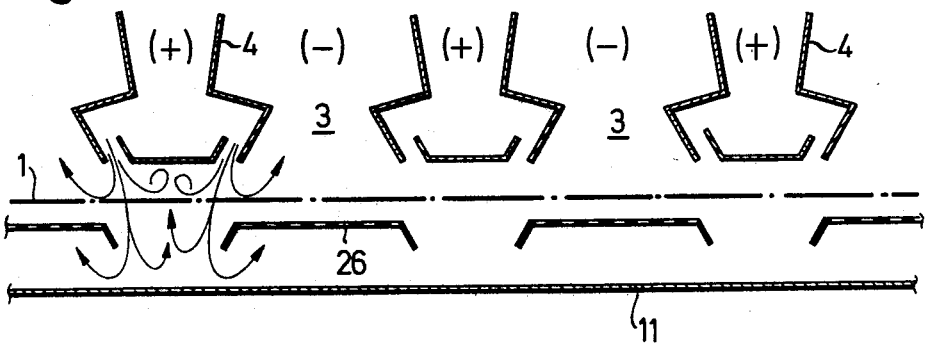
FIG. 14 illustrates a combination of several support effects simultaneously in a stable G-E-system.

In FIGS. 13 and 14 are illustrated two embodiments for the stable receiving jet systems with inner pressure balance in accordance with the invention. In the E-jet system with dynamic supporting jets and inner pressure balance illustrated in FIG. 13, the E-jets arranged below the G-jets on the receiving side are connected together spatially by the distance 22. The dynamic excess is collected on both sides of the E-jets by the injection orifices 23 and diverted into the E-jet slots 24 converging in pairs. Disposed between two E-jets parallel to the material web are fixed connecting walls 26 in FIG. 14. Below the E-jet discharge side is a base 11, which closes the E-jet cavity 15 below. The E-system is obviously closed laterally.

The connecting wall in FIG. 13 is so formed that the jets are alternately constructed from trapezoid profiles. Identical profile dimensions for the structure of the converging jet slots 24 and the connecting bars 25 are produced by an appropriate geometric balance.

The combination of several supporting effects simultaneously in a stable G-E-system is illustrated in FIG. 14.

The dynamic excess originating from the stable G-jets is used on the one hand similarly to the working principle of FIGS. 9, 10, 11, 12 and 13 for the formation of counter-forces to the G-jet directly below the G-jet, and on the other hand a portion of the dynamic excess is conveyed below the perforated connecting walls 26 in order, after exit from the perforation, to form stable and broad-surfaced air cushions in known manner, which press the material web in the direction of the negative zones 3. On this are superposed the suction forces in the suction zones.

In a G-E-system according to FIG. 14 there are consequently four different and interacting forces superimposed one on the other which produce a particularly efficient and stable G-E-system.

According to FIG. 14 the following acts on the material web;

1. The repelling forces of the stable G-jet.
2. The reaction forces of the diffuser jet e.g. disposed below the G-jet.
3. The supporting forces of the broad-surfaced air cushions and
4. The suction forces of the suction between the G-jets.

Altogether an increase in the processing effect or drying or heating of the material web is achieved because the material web is impinged on both sides.

The negative zones assist in holding the material web, particularly in the case of large overlaps, securely in the suspended state.

Figure 15:
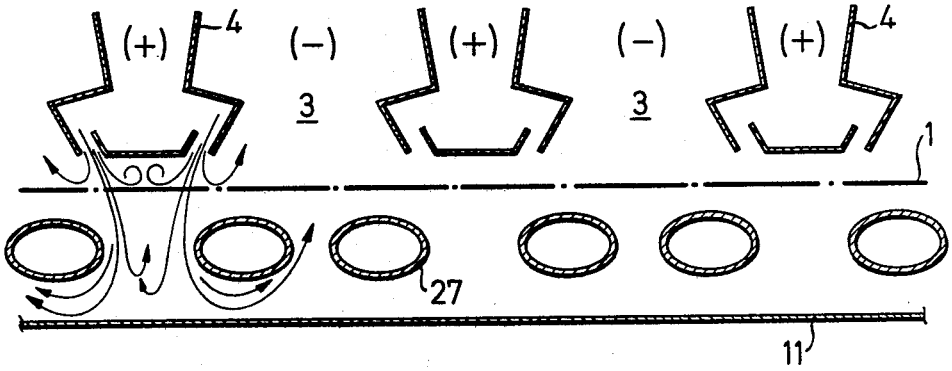
FIGS. 15, 16, 17 and 18 illustrate devices incorporating stable G-E-systems with combined support actions.
Figure 16:
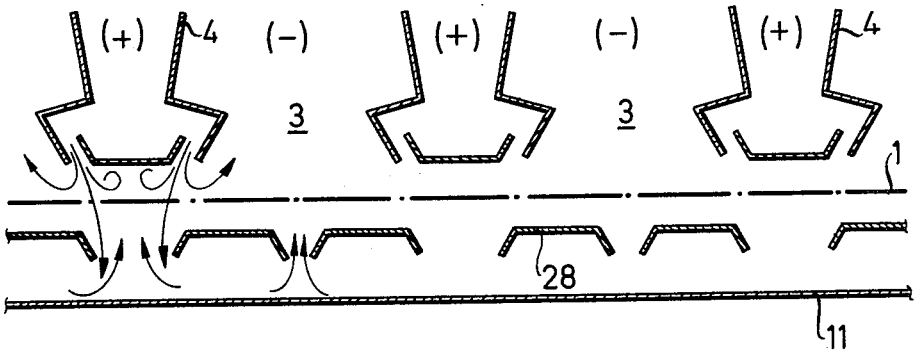

FIGS. 15 and 16 show embodiments which make possible the combined actions of G-jets and E-jets with negative zones. In both cases E-jets are arranged below the G-jets and between the G-jets. In FIG. 15 the E-jets are formed from rounded-off flow bodies 27 which are adjusted to the spacing ratio of the G-jets. Round and/or elliptical tubes are particularly suitable in this respect.

In FIG. 16 the E-jets are constructed from trapezoidal profiles 28 so that below the G-jets and between the G-jets on the E-side, E-jets with diffuser-like structures are produced.

Figure 17:
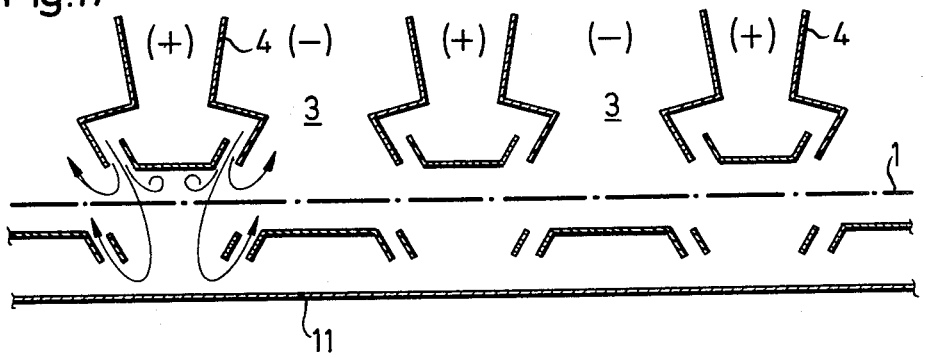
Figure 18:
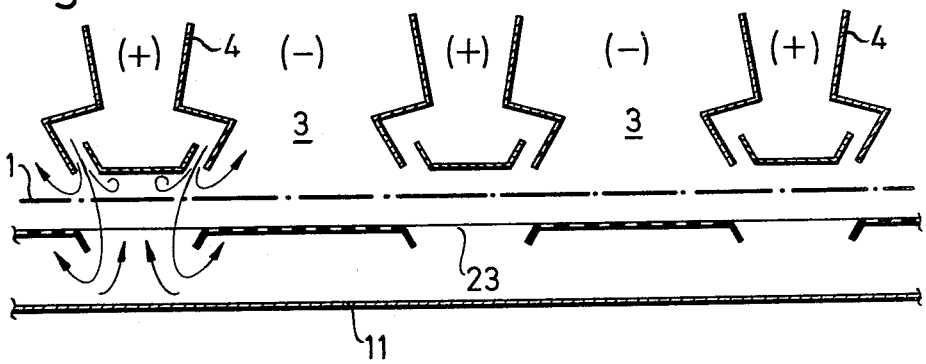

The G-E-variant in FIG. 17 is similar to FIG. 16 but asymmetrical. In FIG. 18 the E-base is continuous as far as the lateral orifices 23 and is perforated.

The devices according to the invention described in FIGS. 6 to 18 are embodiments for the method according to the invention for conveying and processing material webs in the suspended state which may be modified and varied in various ways. It is essential to the invention, however, that a processing of the material web in the suspended state is achieved by means of emitting jets with stable characteristic curves and receiving jets, preferably also with stable characteristic curves.

In comparison with suspension driers, which operate similarly on both sides of the material web, i.e. with separate and homologous or homologously displaced jet systems, the G-E-system according to the invention is simple in construction. Difficulties as, e.g. in the known suspension driers which arise in the absence of unsymmetrical impingement of the material web between two jets caused by different capacities of the ventilators and inaccuracies of manufacture in the jets, wherein unfavorable flow distribution arises in the jets, are more easily compensated by the stable G-E-systems according to the invention in a technically simple manner.

Apart from the described process and the arrangement of the jets according to FIGS. 6 and 18, embodiments are described for the processing devices, in the special drier, which realize the method according to the invention advantageously.

Figure 19:
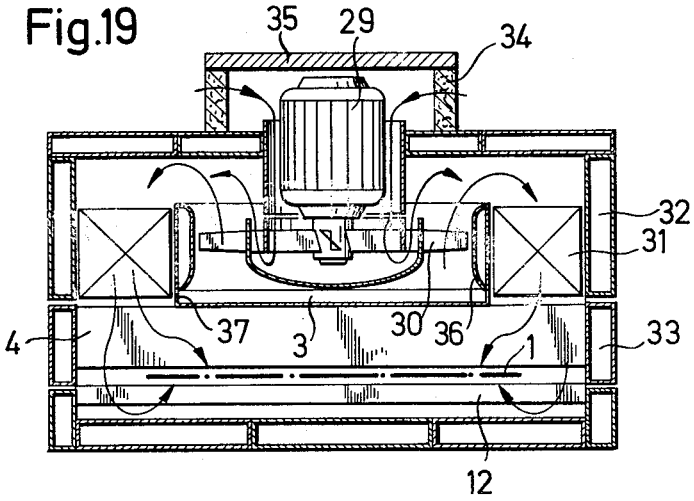
FIG. 19 is a cross-section through a processing device constructed according to FIG. 16.

FIG. 19 is a schematic illustration of a drier, transverse to the through-run direction, for effecting the process of the invention.

Figure 20:
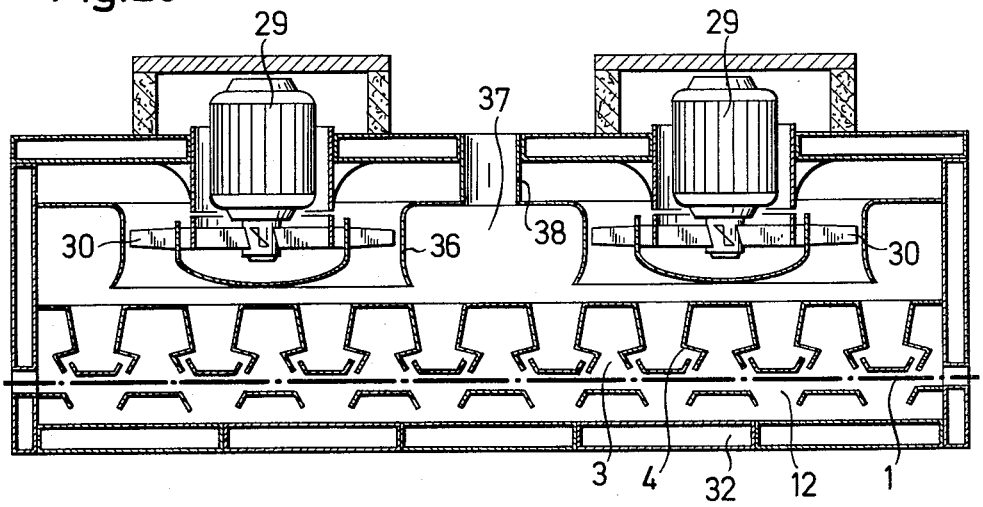
FIG. 20 is a longitudinal section through a processing device constructed according to FIG. 11.

FIG. 20 is a schematic representation of the longitudinal section of the device according to FIG. 11.

Figure 21:
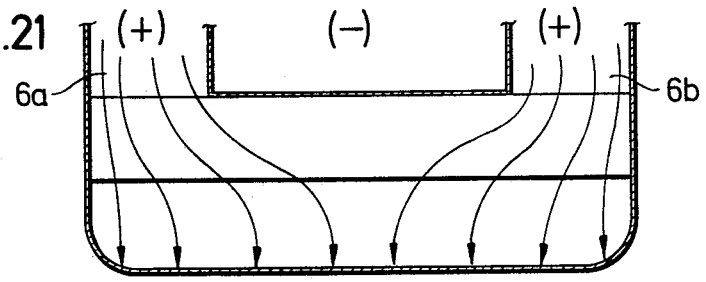
FIG. 21 illustrates the air distribution in the G-Jet with normal dynamic excess.
Figure 22:
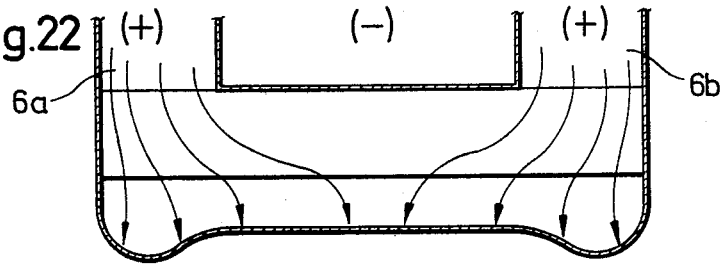
FIG. 22 illustrates the air distribution in the G-jet with reinforced dynamic excess.

The material web 1 is held in suspension by the forces produced by the primary jets 4 and the secondary jets 12. There are, in addition, in a preferred embodiment the forces which act in the suction zones 3. The processing medium, e.g. air, is conveyed in circulation by ventilators 30 driven by motors 29. Heating of the air is carried out in the heat exchangers 31 which are arranged on the pressure side of the ventilators in front of the primary or emitting jets 4. A good distribution of the processing medium is thereby achieved in front of the outlet into the G-jets. The air is thus supplied from both sides of the emitting jets so that an advantageous distribution of the air discharge is achieved. In the normal case the distribution is uniform along the jet outlet according to the velocity distribution of FIG. 21. It may be advantageous in special cases however, if a somewhat higher velocity according to the velocity profile development of FIG. 22 prevails and if the secondary effect e.g. of the E-jets on the rear side of the material e.g. in the case of paper fleece, i.e. in moisture-conducting material or good heat conductors, e.g. metal webs, is to be strengthened by the processing method. The proportion for the dynamic excess of the total quantity which is in the cycle is thus increased. A similar effect is achieved by increasing the outlet cross-section in the G-jet exit sections.

Favorable distribution ratios are generally obtained on the inlet side of the G-jets if the jet inlets (*6a, 6b*) of the primary base in each jet exit section is approximately a quarter of the total jet length. The orifice for the extraction thus lies in the middle between two G-jets, which orifice is approximately 50% of the jet length and is sufficient firstly to achieve good discharge ratios, i.e. a brief reversal of the direction of the air flow behind the G-jet orifice within the width of the material, and secondly to effect a uniform distribution of the diminished pressure in the negative zones.

The dynamic excess which is formed to the left and right of the material web in the projecting exit sections of the primary jets, is, depending on the selected system, which in turn depends on the application of the process of the invention, converted to increase the stabilization, i.e. the transport in the suspended state and if desired for intensifying the processing capacity of the secondary jets.

The drier according to FIGS. 19 and 20 is heat insulated on the outside by the walls 32 and sealed. On the longitudinal sides and over the complete length of the drier are doors or orifices 33 for unimpeded access into the processing zones.

The jets are so formed that they can be removed laterally. The heat exchangers are installed from above i.e. from the G-jet inlet side, and advantageously extend over the entire drier length.

On the drier unit above the motor is in each case an air filter 34 which is provided with a variable covering 35. As a result the quantity of fresh air necessary for the ventilation can be regulated.

In FIGS. 19 and 20 the electric motors 29 are cooled by fresh air. The special embodiment of the ventilators makes it possible for the fresh air to be drawn in by the drier ventilator and conveyed into the cycle. A corresponding quantity of air is drawn in between the ventilators from the draw-in chamber above the primary jets, and is drawn off to the outside. As a result, the drier has few air pipes - that is pipes only for outgoing air - and each drier has an equalized air balance when stringing together at least two drier units.

Disturbing air intakes and discharges at the inlets and outlets of the drier units are thus clearly impossible. Even when the doors are open a remarkable equilibrium of the flow ratios inside the drier units prevails, which is especially to be valued in interruptions in production or the test operation. Since the drive motor for the ventilator is in the fresh air flow, which is approximately 10% of the circulated air flow, the drive motor may be entered deep into the drier, this being particularly advantageous with respect to space.

The uncomplicated, compact and clear construction of the processing device according to FIGS. 19 and 20 is a preferred embodiment for carrying out the method of the invention. Therewith there is e.g. a drier unit which enables particularly interesting combination possibilities in the design of the entire plant, in particular in coating and subsequent drying of material webs, as are necessary e.g. in the modern drying technique of coated webs of material, in particular of paper, foils, textiles, plastics and metals.

It is not important for the method of operation of the process whether the material surface to be treated first is facing upwards or downwards. Likewise, such a device can operate vertically or horizontally. As a result, a good adaptation to the spatial structural conditions is occasionally possible.

The processing, in particular drying of suspended layers, i.e. layers directed over their entire surface towards the ground, can be taken charge of both by the primary and secondary jets, wherein the material web is conveyed aerodynamically during its passage through the processing device.

A particular advantage of the described devices of the invention lies in the simplification, achieved in principle, within the drier systems, which carry out their processing by means of circulated vaporous or gaseous media. It is in fact possible to reduce all known application cases to the stable G-E-system of the invention and to the suspension drier with independent impingement on both sides. By omitting the lower drier portion in the region of the secondary jets, a double-acting suspension drier with known reciprocal action for the necessary special cases may be set up without difficulty. A substantial standardization of the drier parts and the construction of a universal mechanical assembly technique for the drier operating by convection for material webs, is thus given in accordance with the invention.

It is particularly advantageous to produce the drier units completely from drawn aluminum profiles. In this way, exact and particularly cleanly operating driers or processing devices which require relatively low investment for their production, may be obtained without difficulties.

For the outer walls it is advantageous to use hollow aluminum profiles because of their rigidity and potentiality to insulate against heat. The drier units manufactured in this way from aluminum profiles are preferably suitable for the processing of products which must not receive any scratches or dust inclusions during processing, as e.g. in the case of photo-layers and similar materials.

The ventilators illustrated in FIGS. 19 and 20 are axially constructed to assist the air flow. The fresh air is drawn in through the filter 34, flows around the drive motor 29 and is pushed into the cycle at the inner periphery of the axial ventilator 30. The ring 36 takes care of slight losses in pressure in front of and behind the ventilator blading and seals the negative zone 3 against the positive zone 2 by the wall 37.

It may be seen in FIG. 20 how e.g. the outgoing air from the suction zone is drawn-off between the circulating air ventilators through the conduit 38. Normally, a separately installed ventilator takes charge of the outgoing air. The quantity of outgoing air can be regulated by corresponding adjusting mechanisms.

Figure 23:
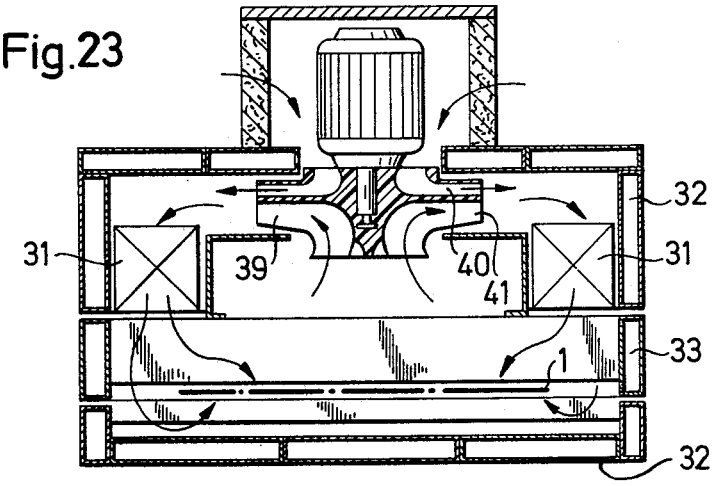
FIG. 23 is a cross-section of a drier with two-bladed radial ventilators.

FIG. 23 is a schematic cross-section of a processing device according to the invention with a different type of ventilator. As is known, it is possible to produce higher pressures in one stage with a radial ventilator than with an axial ventilator. In FIG. 23 the radial ventilator 39 is a double flow ventilator. The ventilator blading 40 in the vicinity of the motor also serves for the motor cooling and the fresh air supply for the drier, while the lower more largely illustrated ventilator 41 serves to maintain the air circulation.

The blading of the fresh air ventilator is designed in such a manner that the pressure produced is always somewhat higher than that of the circulation ventilator.

On account of the better suitability to the respective drying conditions it is advantageous to let the fan motors run at a number of revolutions which is variable or adjustable. Suitable for this are two-speed or hydraulic motors of special design.

Figure 24:
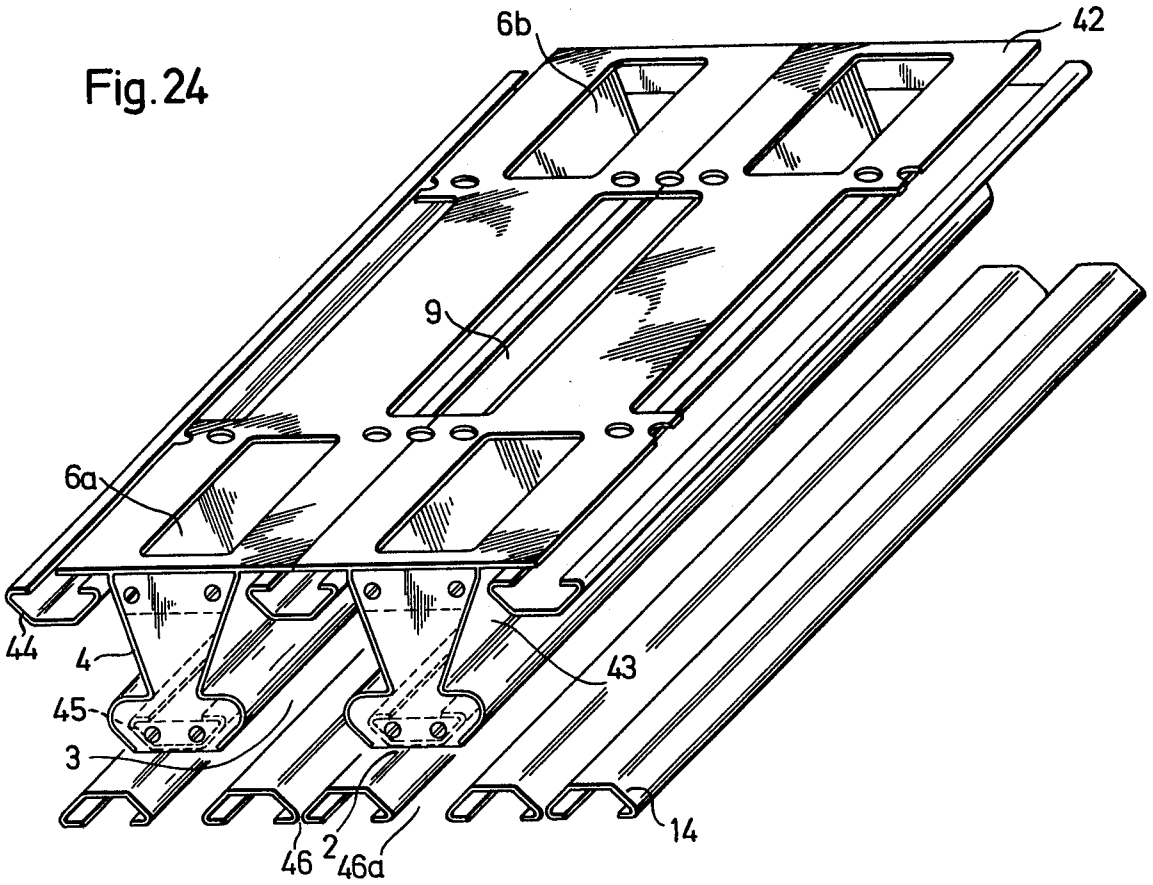
FIG. 24 is a perspective representation of a preferred G-E-system.

FIG. 24 is a perspective illustration of a G-E-system preferred in practice. The G-jet bodies 4 are produced from a profile and are attached to one another and secured to an inner body, not illustrated, by means of a screw joint, for example. The outer-lying jet inlets **6*a* and 6*b* are disposed in the jet base 42. Likewise, in the jet base is an intake cross-section 9 between two emitting jets 4. The jet base 42 separates the positive 2 and the negative chambers 3 from one another by means of the intermediate walls, not illustrated. The suction zones 3 are bounded by the longitudinal sides 43 of the emitting jets 4. In front of the intake cross-section 9 is the flow distributor 44 which passes over the entire length of the emitting jet. The profile of the flow distributor 44 is identical to the profile of the flow body 45 within the G-jets 4. The distance and the type of installation from the flow distributor 44 to the jet base 42 was selected so that a particularly favorable flow distribution was obtained in the suction zone 3. Also, the receiving jets are formed from the same profile as the flow body 45 by appropriate arrangement. Between two G-jets 4 there is formed on the E-side by means of two profiles, a diffuser jet 46 and below each G-jet a further particularly broad-shaped diffuser jet 46*a***. Here the E-jet below the G-jet is substantially broader in the inlet and outlet cross-section than the E-jet between two G-jets. The profiling of the flow body is so coordinated in the total geometry that the different requirements of the processing technique such as good flow distribution and stability are fulfilled.

The E-jets advantageously are inserted in a frame, not illustrated. Consequently it is possible to erect and install an assembled E-system in a simple manner.

In principle, the described processing devices and jet arrangements may be combined one below the other. In a corresponding formation and direction of rotation of the ventilators and corresponding arrangement of the inlet orifices for the G- and E-jets, the flow direction within the cycle can be reversed without influencing the method of the invention. Basically, it is a matter of the structural suitability as to whether the one or the other direction of flow will be taken as a basis.

In any case, a reliable processing of material webs in the suspended state with low technical expenditure is achieved by the process together with the devices according to the invention.

It will be obvious to those skilled in the art that many modifications may be made within the scope of the present invention without departing from the spirit thereof, and the invention includes all such modifications.

What is claimed is:

1. A method for freely suspending a moving web of material in a gaseous medium, which comprises impinging, by means of a stable emitting system, a stream of gaseous medium onto the surface of the web from one side only in order to produce at least one stationary stable pressure zone, in which a repelling force decreases continually with an increasing distance from the emitting system, forming at least one stationary stable suction zone adjacent said stationary pressure zone, in which a suction force decreases continually with an increasing distance from means forming the suction zone to a smaller degree than the repelling force in the pressure zone, and regulating the applied stable pressure of the stable emitting system and the suction of the stable suction zone in order to make the repelling force equal to the suction force at the zone where the web is freely suspended between the emitting system and the means forming the suction zone.

2. A method according to claim 1 including producing the pressure zone by a slot-shaped stream of gaseous medium.

3. A method according to claim 2 including producing a plurality of stable pressure zones by slot-shaped streams converging in pairs, while preventing downflow to the inside of the stream, transverse to the direction of movement of the material web.

4. A method according to claim 1 including impinging the material web with streams of a heated gaseous medium.

5. A method according to claim 1 including producing a uniform flow field in the suction zone transverse to the material web.

6. A method according to claim 1 including removing the gaseous medium from the suction zone in a direction substantially perpendicular to the material web after impingement thereon.

7. A method according to claim 1 including distributing the stream of the gaseous medium in a uniform manner in a direction transverse to the direction of the material web.

8. A method according to claim 1 including regulating the velocity of said gaseous medium between about zero and 60 m/sec.

9. A method according to claim 1 including directing the gaseous medium at the material web in a manner such that stable pressure zones are formed perpendicular and transverse to the direction of movement of the web.

10. A method for freely suspending a moving web of material in a gaseous medium, which comprises impinging, by means of a stable emitting system, a stream of the gaseous medium over the entire width of one surface of the web in order to produce a first stationary stable pressure zone, in which a repelling force decreases continually with an increasing distance from the emitting system, forming at least one stationary stable suction zone adjacent said first stationary stable pressure zone, in which a suction force decreases continually with an increasing distance from means forming the suction zone, deflecting the gaseous medium passing beyond the edges of the web in order to produce a second stationary stable pressure zone on the opposite side of the web, in which a repelling force on said opposite side decreases continually with an increasing distance from means forming the second pressure zone, and regulating said pressure and suction zones in order to maintain the web in a freely suspended state.

11. A method according to claim 10 including deflecting the gaseous excess in a manner such that a static counter-pressure is produced opposite the stable pressure zone.

12. A method according to claim 10 including deflecting the gaseous excess in a manner such that a dynamic counter-pressure is produced opposite the stable pressure zone.

13. A method according to claim 10 in which the discharge quantity and velocity of the gaseous medium in the portion passing beyond the edges of the web are higher than in the region of impingement on the web.

14. A method according to claim 10 including deflecting the gaseous excess in a manner such that counter-pressure forces in any supporting region have a stable characteristic curve.

15. An apparatus for freely suspending a moving web of material in a gaseous medium which comprises housing means, transverse jet means of stable characteristic curve in said housing means and having a length greater than the width of a web passed through said housing means, said transverse jet means exercising a repelling force on the web which decreases continually with an increasing distance between said jet means, suction means mounted adjacent said jet means, said suction means including means enabling transverse suction and substantially perpendicular suction over the material web, said suction means producing a suction force which decreases continually with an increasing distance from the suction means to a smaller degree than the repelling force decreases continually depending on the distance between the web and the jet means, whereby the repelling force is equal to the suction force at the zone where the web is freely suspended between the jet means and the suction means, and stable receiving means mounted opposite said jet means whereby the dynamic excess of said gaseous medium flowing over the edges of the web is collected and turned around, said receiving means exercising a repelling force on the web which decreases continually with an increasing distance to the receiving means.

16. An apparatus according to claim 15 in which the jet means is a plurality of slot jet means.

17. An apparatus according to claim 16 in which the slot jet means converge in pairs.

18. An apparatus according to claim 15 including heat exchanger means for heating said gaseous medium.

19. An apparatus according to claim 15 in which said stable receiving means includes at least one statically operating diffuser jet means.

20. An apparatus according to claim 15 in which said stable receiving means includes at least one dynamically operating jet means.

21. An apparatus according to claim 15 in which said stable receiving means includes at least one statically and dynamically operating jet means.

22. An apparatus according to claim 15 in which intake cross-sections of the jet means in the ends of the jet means projecting beyond the edges of the material web are greater than in the impingement region.

23. An apparatus according to claim 15 in which the jet means are partially covered in areas corresponding to the width of the web and emit the gaseous medium at a higher discharge velocity than in the impingement region.

24. An apparatus according to claim 15 in which the stable receiving means has a stable characteristic curve.

25. An apparatus according to claim 15 in which the stable receiving means are receiving jets mounted opposite the jet means.

26. An apparatus according to claim 25 in which the receiving jets are staggered opposite the jet means.

27. An apparatus according to claim 15 in which the stable receiving means are receiving jets mounted opposite and staggered opposite the jet means.

28. An apparatus according to claim 15 in which the stable receiving means are receiving jets having jet orifices substantially wider than those of the jet means.

29. An apparatus for freely suspending and moving a web of material in a gaseous medium which comprises housing means, at least one transverse jet means of stable characteristic curve in said housing means mounted on one side only relative to the moving web and having a length no greater than the width of a web passed through said housing means, said jet means exercising a repelling force on the web which decreases continually with an increasing distance between the web and the jet means, and suction means mounted adjacent said jet means for producing a stable suction zone, said suction means producing a suction force which decreases continually with an increasing distance from the suction means to a smaller degree than the repelling force decreases depending on the distance between the web and the jet means, whereby the repelling force is equal to the suction force at the zone where the web is freely suspended between the jet means and the suction means.

* * * * *